US005155313A

United States Patent [19]

Dufournet et al.

[11] Patent Number: 5,155,313

[45] Date of Patent: Oct. 13, 1992

[54] MEDIUM TENSION CIRCUIT-BREAKER

[75] Inventors: Denis Dufournet, Bron; Michel Perret, Bourgoin-Jallieu, both of France

[73] Assignee: GEC Alsthom SA, Paris, France

[21] Appl. No.: 691,874

[22] Filed: Apr. 26, 1991

[30] Foreign Application Priority Data

May 23, 1990 [FR] France ..... 90 06458

[51] Int. Cl.[5] ..... H01H 33/88

[52] U.S. Cl. ..... 200/148 A; 200/148 B; 200/148 R

[58] Field of Search ..... 200/148 R, 148 A, 148 B, 200/150 G

[56] References Cited

U.S. PATENT DOCUMENTS

| | | | |
|---|---|---|---|
| 4,225,762 | 9/1980 | Zuckler | 200/144 R |
| 4,320,270 | 3/1982 | Graf et al. | 200/148 A |
| 4,327,263 | 4/1982 | Sakurai et al. | 200/148 A |
| 4,577,073 | 3/1986 | Talpo | 200/148 A |
| 4,950,855 | 8/1990 | Bolongeat-Mobleu et al. | 200/148 A |

FOREIGN PATENT DOCUMENTS

| | | |
|---|---|---|
| 0149470 | 7/1985 | European Pat. Off. . |
| 0315505 | 5/1989 | European Pat. Off. . |
| 3727802 | 3/1989 | Fed. Rep. of Germany . |
| 2356258 | 1/1978 | France . |

*Primary Examiner*—J. R. Scott

*Attorney, Agent, or Firm*—Sughrue, Mion, Zinn, Macpeak & Seas

[57] ABSTRACT

A medium tension circuit-breaker has a gastight insulating case filled with a gas having good dielectric properties. A semi-moving arcing contact is electrically connected to a first terminal and a moving contact is mechanically connected to a drive mechanism and electrically connected to a second terminal. The semi-moving arcing contact is connected to a piston movable in a blast volume delimited in particular by the inside wall of an insulating cylinder which is inside the case and by a first face of a blast nozzle. The piston receives thrust from a spring in which energy is stored when the circuit-breaker is in the engaged position. The circuit-breaker includes a thermal expansion volume delimited in particular by the inside wall of the cylinder, by a second face of the nozzle, and by a transverse partition through which the moving contact slides. When interrupting high currents, once the piston has completed its stroke in the direction of compression of the blast volume, the piston is prevented from moving back in the opposite direction.

7 Claims, 4 Drawing Sheets 18
9
2
20
V3
S4
6
4
3
5
3A
10A
1
8
7A
7
V1
7C
S3
S2
7B
7D
15
16
21
15A
10
8A
V2
12
11
13
V4

18
9
2
20
V3
4
1
8
6
3
5
7A
7
V1
3A
Se
7C
25
7B
10A
7D
15
16
21
15A
10
8A
V2
12
11
V4

18
9
2
20
V3
6
4
30
5
10A
30A
1
8
7A
7C
7
V1
7B
7D
15
21
16
15A
10
8A
V2
12
11
13
V4

MEDIUM TENSION CIRCUIT-BREAKER

The present invention relates to a medium tension circuit-breaker in which electrical insulation is provided by a gas having good dielectric properties, such as sulfur hexafluoride ($SF_6$).

BACKGROUND OF THE INVENTION

Medium tension circuit-breakers are known having a thermal expansion volume ("thermal volume" for short) in which gas, on being heated by the arc which develops when the arcing contacts separate, expands and blasts the arc on current zero.

It is known that implementing such apparatus gives rise to the following difficulties:

when interrupting low currents (e.g. currents not greater than the nominal current in the line or the installation in which the circuit-breaker is inserted), the pressure build-up may be insufficient or, on the contrary, too great, depending on the size of the thermal volume. If the thermal volume is large, then the pressure build-up is small and the blast may be insufficient. If the thermal volume is small, then the pressure build-up is large, but the blast duration may be insufficient to give good efficiency; and when interrupting high currents (e.g. short-circuit currents), the pressure build-up and the temperature rise in the gas must not be too large, since this could lead to interruption failure.

In order to solve this problem, proposals have been made, in particular in the document EP-A-0315505, to provide an interrupting chamber (used as a thermal volume) which is variable in volume, depending on the strength of the current to be interrupted.

This is achieved by replacing the fixed arcing contact usually found in circuit-breakers, by a semi-moving contact connected to a piston which is pushed back by an opposing spring.

Depending on the strength of the current to be interrupted, the piston is displaced to a greater or lesser extent, giving rise to a larger or smaller thermal volume.

Such apparatus suffers from a drawback.

When interrupting high currents, the full and rapid return of the semi-moving contact that the spring is incapable of limiting, produces an exaggerated lengthening of the arc and this causes the temperature of the gas to rise excessively, entailing a risk of interruption failure and of major pollution of the insulating gas which could lead to the failure of subsequent interruptions.

An object of the present invention is to provide a medium tension circuit-breaker which does not suffer from this drawback.

Another object of the invention is to provide a circuit-breaker in which, for interrupting high currents, double blasting is performed, i.e. one blast on each of the roots of the arc.

Another object of the invention is to provide a circuit-breaker in which the thermal expansion of the gas is limited, so as to reduce the risks of interruption failure.

SUMMARY OF THE INVENTION

All these objects are achieved by the medium tension circuit-breaker of the invention which comprises a gastight insulating case filled with a gas having good dielectric properties, a semi-fixed arcing contact electrically connected to a first terminal and a moving contact mechanically connected to a drive mechanism and electrically connected to a second terminal, and wherein the semi-moving arcing contact is connected to a piston movable in a blast volume delimited in particular by the inside wall of an insulating cylinder which is inside said case and by a first face of a blast nozzle, said piston receiving thrust from a spring in which energy is stored when the circuit-breaker is in the engaged position, said circuit-breaker including a thermal expansion volume delimited in particular by the inside wall of said cylinder, by a second face of the nozzle, and by a transverse partition through which the moving contact slides, means being provided so that, when interrupting high currents, once the piston has completed its stroke in the direction of compression of the blast volume, it is prevented from moving back in the opposite direction.

In a particular embodiment, the means for preventing the piston from moving back in the opposite direction are constituted by a gas flow section area between the throat of the nozzle and the blast volume, that is less than the sum of the areas of the other passages available to the gas escaping from the thermal expansion volume.

In a first embodiment, the semi-moving contact is a tubular contact establishing communication between the blast volume and the volume situated behind the piston.

In a variant, the semi-moving contact is a solid rod.

In a particular embodiment, the moving contact is a tubular contact.

Advantageously, the moving contact has at least one perforation positioned so as to allow the moving contact end nearest the nozzle to communicate with the inside of the thermal expansion volume over a portion of the stroke of this moving contact during disengagement of the circuit-breaker.

The insulating cylinder includes holes to provide communication between the volume situated behind the piston and the volume lying between said cylinder and said case.

BRIEF DESCRIPTION OF THE DRAWINGS

An embodiment of the invention is described by way of example with reference to the accompanying drawings, in which.

DETAILED DESCRIPTION

Figure 1:
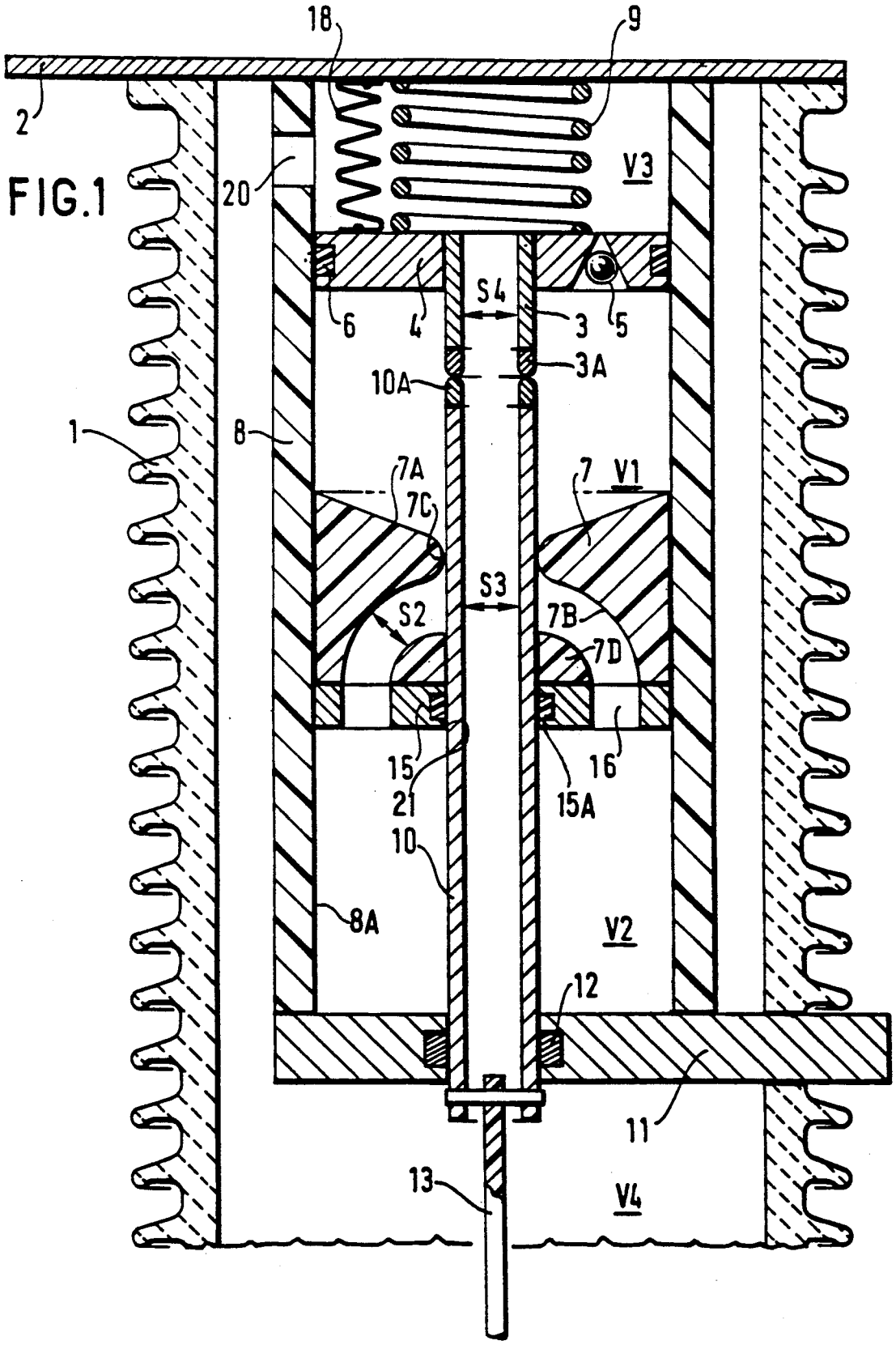
FIG. 1 is a fragmentary diagrammatic view in axial section through a circuit-breaker of the invention, shown in its engaged position.
Figure 2:
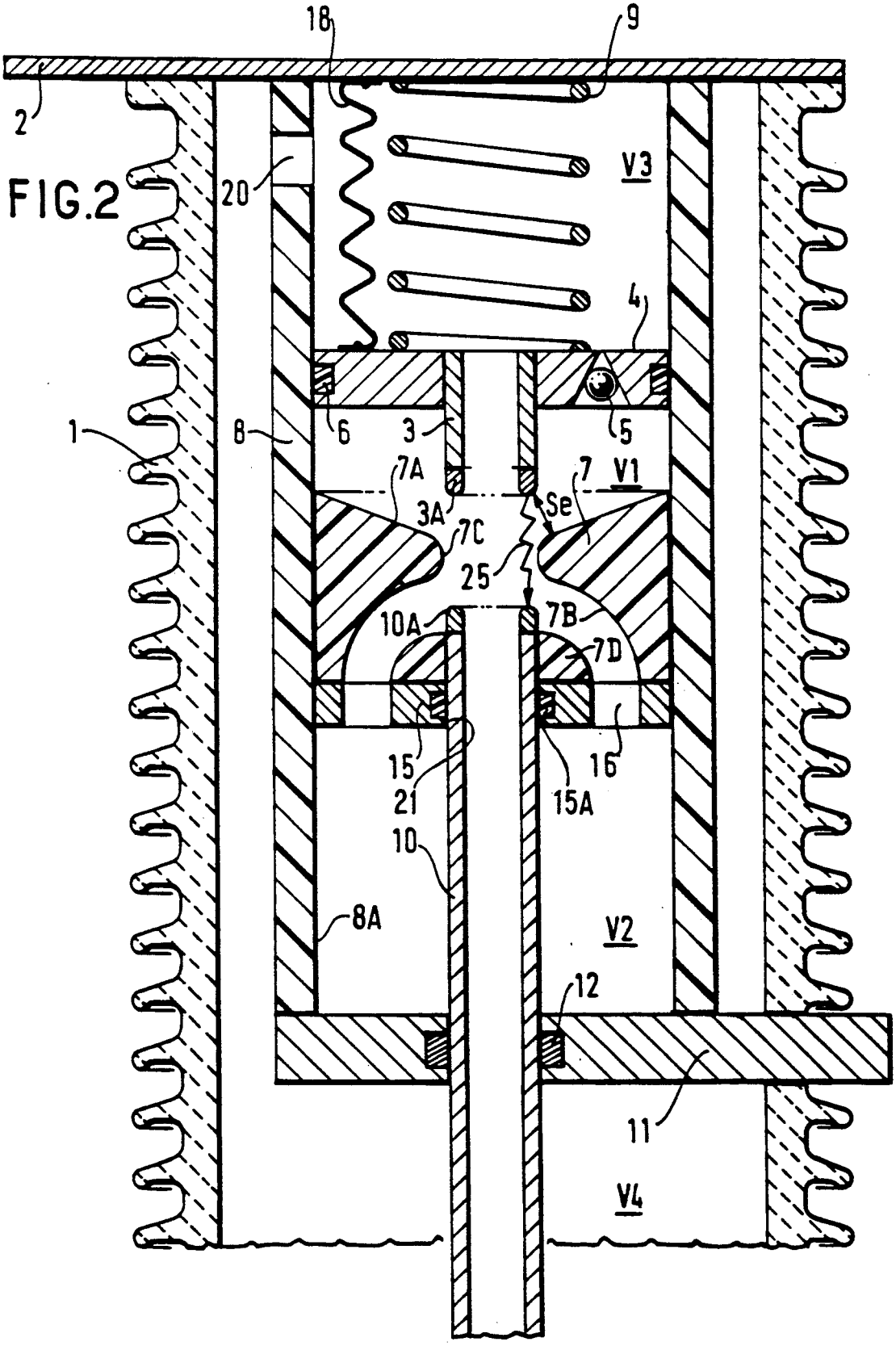
FIG. 2 is a fragmentary diagrammatic view in axial section through the same circuit-breaker, shown in its disengaged position.

In the figures, reference 1 designates a gastight case made of an insulating material and filled with a gas which has good dielectric properties, such as sulfur hexafluoride, under a pressure in the range of 1 to a few bars absolute.

The case 1 is closed at its top by a metal plate 2 which is extended to constitute a first terminal of the circuit breaker.

This terminal 2 is electrically connected by a flexible metal braid 18 to a metal piston 4 which has a tubular metal contact 3, whose end 3A is made of an alloy that withstands the effect of arcing, e.g. a tungsten based alloy. This contact 3 is designated below by the term "semi-moving" contact. The piston 4 is slidably mounted in a cylindrical volume delimited by the inside wall 8*a* of the insulating cylinder 8 which runs coaxially with the case 1 and inside it, and which constitutes the wall of the interruption chamber. The piston 4 which has a peripheral ring 6 contacting cylinder wall 8*a* is displaced by the action of a powerful spring 9 which bears against the plate 2. The piston 4 is fitted with a non-return valve 5 which allows the gas to pass only in the direction going from the volume V3 on the spring side of the piston, to the blast volume V1 which is defined below. This non-return valve 5 opens when the circuit-breaker is re-closed and prevents the gas in volume V3 from being compressed.

The blast volume V1 is delimited by the piston 4, the internal wall of the cylinder 8 and one face 7A of an insulating nozzle 7 which has a throat 7C.

The moving contact of the circuit-breaker is constituted by a metal tube 10 having an end-piece 10A made of a material that withstands the effects of arcing added on one end thereof, and which is connected at its other end to a drive rod 13 made of an insulating material.

This rod 13 is conventionally connected to a drive mechanism.

The tubular contact 10 passes snugly through the throat 7*c* of the nozzle 7 when the circuit-breaker is in the engaged position, as shown in FIG. 1.

A thermal expansion volume V2 is constituted by the inside wall of the cylinder 8, the other face 7B of the nozzle 7 and a transverse metal partition 11 which extends outside the case 1 to form a second terminal of the circuit-breaker. A sliding electric contact 12 provides the electrical connection between the tube 10 and the terminal 11.

The tube 10 is preferably guided by a metal or insulating transverse partition 15 which has an axial hole 21 through which passes tube 10 in contact with ring seal 15*a* and has two wide orifices 16 to allow the gas to pass through. An insulating piece 7D enables the streams of gas to be better guided. The insulating piece 7D may be separate and fixed to the partition 15 or it may be an integral part of the nozzle 7.

The circuit-breaker operates as follows:

In the engaged position (FIG. 1), the spring 9 is held back, the tubes 3 and 10 are in contact, volume V1 is at its maximum and the current flows via the terminal 2, the braid 18, the piston 4, the tubes 3 and 10, the contacts 12 and the terminal 11.

On disengagement, the drive mechanism drives the rod 13 downwards in the figure. The spring 9 pushes the piston 4 which compresses the gas in volume V1 which is closed since the tube 10 obstructs the throat 7*c* of the nozzle 7. When the spring 9 is fully relaxed (or, in a variant not shown, when the piston 4 reaches an abutment), the contacts 3 and 10 separate, the contact 3 stopping with the piston 4 and the contact 10 continuing its stroke. An arc 25 is then struck between the end pieces 3A and 10A. At this point, a distinction must made between interrupting low currents and interrupting high currents.

INTERRUPTING LOW CURRENTS

This concerns currents not greater than the nominal current.

Interruption is performed by the arc near the semi-moving contact 3 being pneumatically blasted by the expanding gas in the blast volume V1.

The pressure build-up in volume V2 is negligible.

INTERRUPTING HIGH CURRENTS

This concerns short-circuit currents.

On separation of the contacts, the arc 25 which is of considerable energy transmits a portion of this energy to the gas in the thermal expansion volume V2. This transmission is facilitated by the considerable size of the access area S2 leading to volume V2. The result of this energy transmission is to build up increased pressure in volume V2. At current zero, this increased pressure is released via the orifices 16 (area S2) and via the insides of the tubes 10 (area S3) and 3 (area S4), thereby blasting the arc.

Since the area Se of the passage between the end of the tube 3 and the nozzle 7 (access to volume V1) is very much smaller than the area S2 and the nozzle 7 opening, the pressure in volume V1 results mainly from the piston 4 being compressed, and is due only very slightly to the gas being heated by the arc. Therefore, the force of the spring 9 always remains greater than the opposing force of the pressure increase, and so the piston 4 does not return during disengagement.

When interrupting high currents, the above-described construction effects a double blast, i.e. a blast on each of the roots of the arc. This guarantees that the arc is properly extinguished.

During disengagement, volume V3 (which is situated behind the piston) is supplied with gas because of the openings 20 and also because of the semi-moving contact 3 being a tube. This avoids any drop in pressure behind the piston that would otherwise cause extra drive energy to be consumed. Hole 20 also communicates volume V4 between the case 1 and cylinder 8 to the volume V3 behind the piston 4.

During re-closure of the circuit-breaker, fresh gas passes from volume V3 to volume V1, and this quickly regenerates the dielectric qualities of the gas in the blast volume V1.

Figure 3:
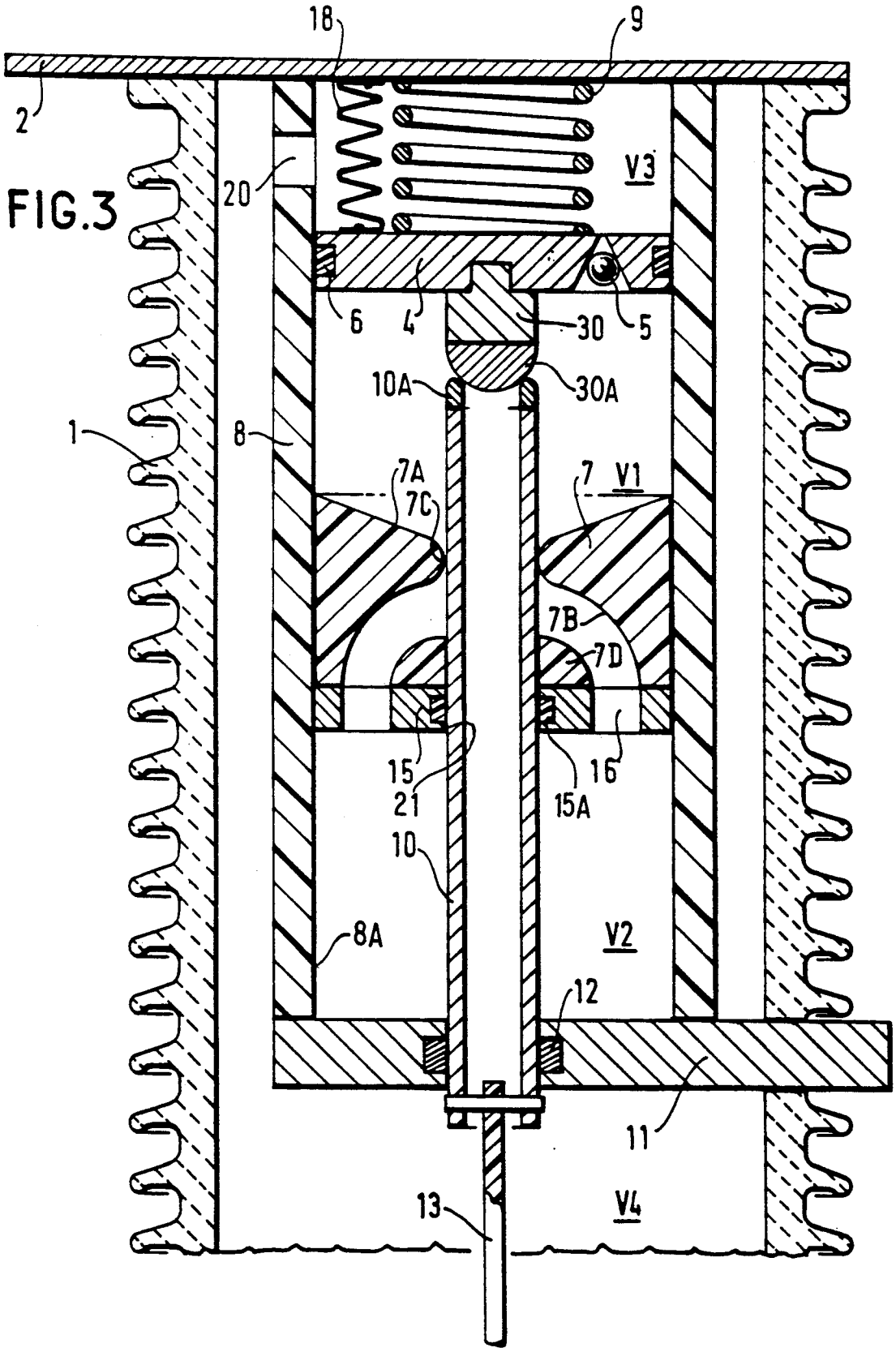
FIG. 3 shows a variant embodiment of the semi-moving contact.

FIG. 3 shows a variant in which the semi-moving contact is a solid rod 30 having a semi-spherical arcing tip or end 30*a* which engages the arcing tip or end 10*a* of moving contact 10. This arrangement is simpler to construct while giving the circuit-breaker almost the same interrupting qualities.

Figure 5:
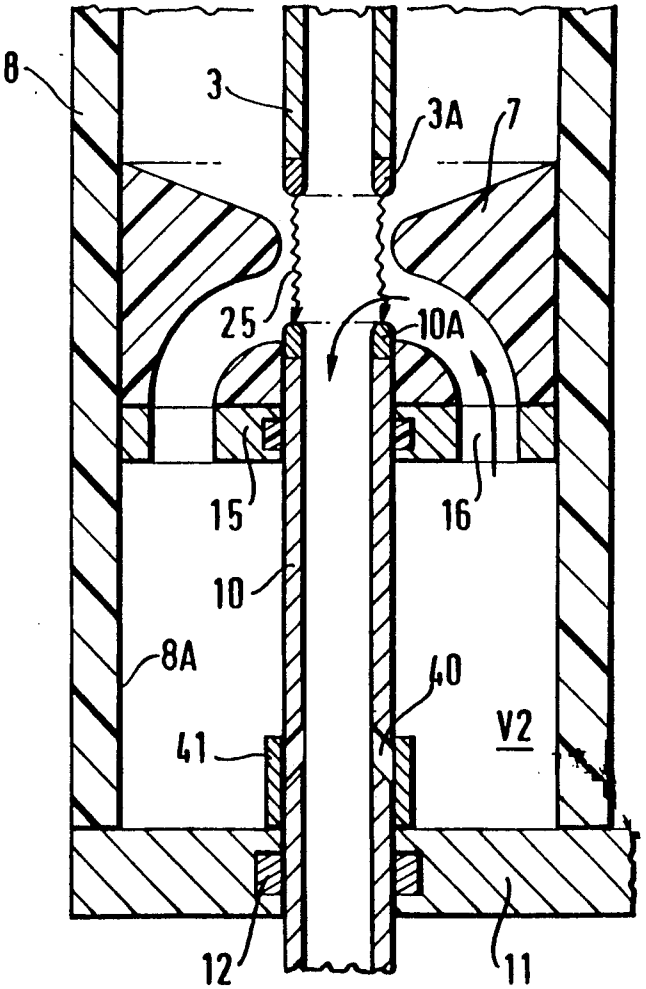
FIGS. 4 and 5 are fragmentary views in axial section through the circuit-breaker (the moving contact of which has holes) shown respectively at the start of contact separation and at a slightly later time.
Figure 4:
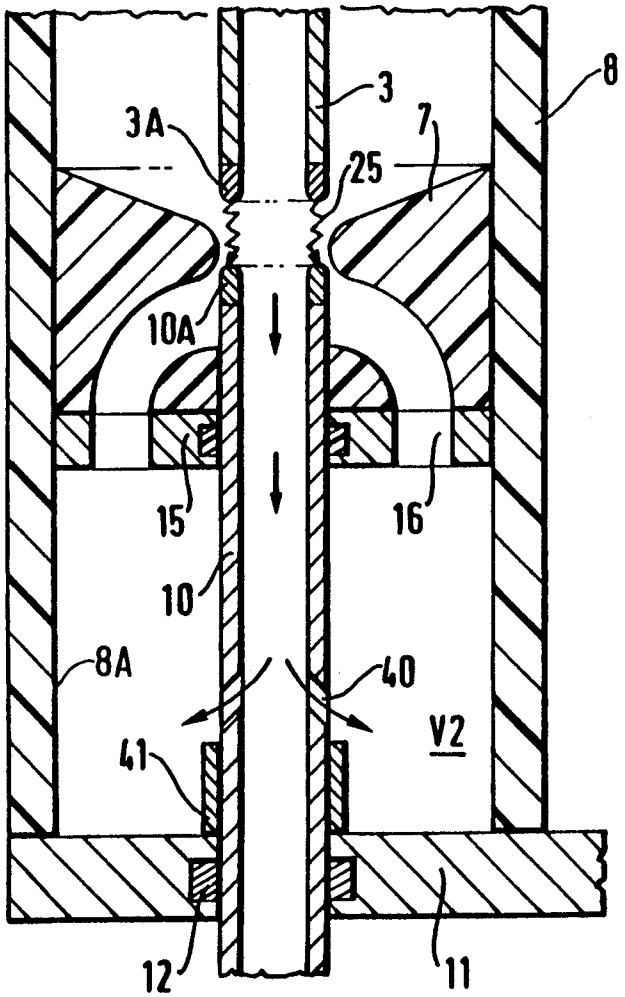

FIGS. 4 and 5 show a variant embodiment in which holes 40 are made in the tubular moving contact 10.

Immediately after the contacts have been separated (FIG. 4), the gas heated by the arc passes through the tube 10 and out through the holes 40, and starts to preheat the gas in the thermal expansion volume V2.

Subsequently, after the tube has been displaced to a certain extent, the holes are obstructed by a sleeve 41 which is slidably engaged with respect to the moving contact 10, which enables the gas to expand solely via holes 16.

This arrangement further increases the efficiency of gas expansion in volume V2.

The invention applies to the construction of medium tension circuit-breakers, e.g. circuit-breakers for up to 45 kV.

We claim:

1. A medium tension circuit-breaker comprising a gastight insulating case filled with a gas having good dielectric properties, a semi-moving arcing contact movable away from and electrically connected to a first terminal and a moving contact mechanically connected to a drive mechanism and electrically connected to a second terminal, wherein the semi-moving arcing contact is connected to a piston movable in a blast volume delimited in particular by the inside wall of an insulating cylinder which is inside said case and by a first face of a blast nozzle, said piston receiving thrust from a spring in which energy is stored when the circuit-breaker is in the engaged position, said circuit-breaker including a thermal expansion volume delimited in particular by the inside wall of said cylinder, by a second face of the blast nozzle, and by a transverse partition through which the moving contact slides, and means for preventing the piston from moving back in the opposite direction, when interrupting high currents, once the piston has completed its stroke in the direction of compression of the blast volume.

2. A circuit-breaker according to claim 1, wherein the means for preventing the piston from moving back in the opposite direction is constituted by a gas flow section having a cross-sectional area in a passage between the throat of the nozzle and the blast volume, that is less than the sum of the cross-sectional areas of other passages in the nozzle, moving arcing contact and the semi-moving contact respectively connected to said passage, open to the gas escaping from the thermal expansion volume.

3. A circuit-breaker according to claim 1, wherein the semi-moving arcing contact comprises a tubular contact open at opposite ends to a volume behind the piston and the blast volume for establishing communication between the blast volume and the volume situated behind the piston.

4. A circuit-breaker according to claim 1, wherein the semi-moving arcing contact is a solid rod.

5. A circuit-breaker according to claim 1, wherein the moving contact is a tubular contact.

6. A circuit-breaker according to claim 5, wherein the moving contact selectively opens and closes at least one passage acting to communicate the blast nozzle with the inside of the thermal expansion volume over a portion of the stroke of said moving arcing contact during disengagement of the circuit-breaker arcing contacts.

7. A circuit-breaker according to claim 1, wherein the insulating cylinder includes at least one hole communicating between the volume situated behind the piston and the volume lying between said cylinder and said case.

* * * * *